US012685361B2

(12) United States Patent
Busch

(10) Patent No.: US 12,685,361 B2
(45) Date of Patent: Jul. 21, 2026

(54) SAFETY HELMET

(71) Applicant: Busch PROtective Germany Gmbh & Co. KG, Guetersloh (DE)

(72) Inventor: Edwin Busch, Guetersloh (DE)

(73) Assignee: Busch PROtective Germany GmbH & Co. KG, Guetersloh (DE)

( * ) Notice: Subject to any disclaimer, the term of this patent is extended or adjusted under 35 U.S.C. 154(b) by 0 days.

(21) Appl. No.: 19/059,714

(22) Filed: Feb. 21, 2025

(65) Prior Publication Data

US 2025/0268329 A1 Aug. 28, 2025

(30) Foreign Application Priority Data

Feb. 22, 2024 (DE) ..... 10 2024 104 999.5

(51) Int. Cl.
*A42B 3/14* (2006.01)
*A42B 3/12* (2006.01)
*A42B 3/04* (2006.01)

(52) U.S. Cl.
CPC ..... *A42B 3/127* (2013.01)

(58) Field of Classification Search
CPC ..... A42B 3/127; A42B 3/14
See application file for complete search history.

(56) References Cited

U.S. PATENT DOCUMENTS 2,398,561 A * 4/1946 Ruggiero ..... A42B 3/14 2/410
2,536,467 A * 1/1951 Ruggiero ..... A42B 3/14 2/416
2,710,965 A * 6/1955 Bowers ..... A42B 3/14 2/8.1
2,757,147 A * 7/1956 Pooley ..... C08J 9/0061 521/88
2,763,005 A * 9/1956 Richter ..... A42B 3/12 2/10
2,879,513 A * 3/1959 Hornickel ..... A42B 3/14 2/414
2,967,304 A * 1/1961 Austin ..... A42B 3/14 2/417
2,983,923 A * 5/1961 Aileo ..... A42B 3/14 2/418
3,020,551 A * 2/1962 Austin ..... A42B 3/14 2/419
3,087,164 A * 4/1963 Gilbert ..... A42B 3/14 2/419
3,092,837 A * 6/1963 Austin ..... A42B 3/145 2/419

(Continued)

FOREIGN PATENT DOCUMENTS

DE 1951312 U 12/1966
DE 102010050678 B3 4/2012

(Continued)

*Primary Examiner* — Robert H Muromoto, Jr.
(74) *Attorney, Agent, or Firm* — Scully, Scott, Murphy & Presser, P.C.

(57) ABSTRACT

A safety helmet including a helmet shell and a carrying frame. The carrying frame including an annular fastening crown. Wherein the fastening crown is one of fixed to the interior of the helmet shell or is configured as a component of the interior of the helmet shell and the carrying frame includes at least one stiffened leg element extending free-standing from the fastening crown in a direction of a helmet shell lower edge of the safety helmet.

20 Claims, 4 Drawing Sheets

(56) References Cited

U.S. PATENT DOCUMENTS 3,154,788 A * 11/1964 Simpson ..... A42B 3/145 2/418
3,221,340 A * 12/1965 Joffe ..... A42B 3/14 2/417
3,258,010 A * 6/1966 Austin ..... A62B 18/04 D24/110.2
3,320,619 A * 5/1967 Lastnik ..... F41H 1/08 2/2.5
3,497,873 A * 3/1970 Benner ..... A42B 3/14 2/416
3,696,440 A * 10/1972 Littleton ..... A42B 3/145 2/418
3,696,441 A * 10/1972 Littleton ..... A42B 3/145 2/418
4,056,852 A * 11/1977 Greendale ..... A42B 3/145 2/909
5,044,019 A * 9/1991 Shewchenko ..... A42B 3/085 2/416
2003/0139104 A1* 7/2003 Arai ..... B32B 27/12 442/45
2006/0206994 A1* 9/2006 Rogers ..... A42B 3/145 2/418
2014/0109297 A1* 4/2014 Lanez ..... A42B 3/04 2/411
2017/0296707 A1* 10/2017 Joyce ..... C08L 23/12
2020/0217621 A1* 7/2020 Busch ..... F16B 37/125

FOREIGN PATENT DOCUMENTS

DE 102013210520 A1 12/2014
JP S52138917 U 10/1977
JP 2015006650 A * 1/2015
JP 2023172937 A 12/2023
KR 20170002610 U 7/2017

* cited by examiner

SAFETY HELMET

CROSS-REFERENCE TO RELATED APPLICATION

The present application is based upon and claims the benefit of priority from DE 10 2024 104 999.5 filed on Feb. 22, 2024, the entire contents of each of which is incorporated herein by reference.

BACKGROUND

Field

The present disclosure relates to a safety helmet.

Prior Art

Safety helmets are worn in a plurality of different professions and activities. For example, various types of safety helmets are used by policemen, firefighters, soldiers and mountain rescuers. In many sports as well, safety helmets are also used, for example as bicycle helmets or riding helmets.

The main function of a safety helmet is usually to protect the head. A major risk to the user exists inter alia from impacts to the head, for example caused by falls or objects that strike the helmet. In order to reduce the negative consequences of such an impact, safety helmets frequently include paddings and shock-absorbing elements that are intended to dampen the impact. However, such shock-absorbing elements are frequently bulky and reduce the wearing comfort of the user.

In addition, other helmet components and helmet accessories such as for example earmuffs, headphones, protective nets and the like are frequently located in the helmet interior in addition to shock-absorbing elements.

SUMMARY

An object is to provide a safety helmet that has improved safety, fastening options for helmet accessories, and wearing comfort.

Such object can be achieved by a safety helmet comprising a helmet shell and a carrying frame, wherein the carrying frame comprises an annular fastening crown, wherein the fastening crown is fixed to the interior of the helmet shell or is configured as a component of the interior of the helmet shell, wherein the carrying frame comprises at least one stiffened leg element, wherein the leg element extends free-standing starting from the fastening crown in the direction of a helmet shell lower edge of the safety helmet.

By such carrying frame which is fixed to the helmet shell by the fastening crown, a fastening option can be provided for helmet components and helmet accessories on the interior of the helmet without the helmet shell being weakened from holes. Fastening to the interior of the helmet shell by a Velcro fastener, as is often frequently done for shock-absorbing pads, is also unnecessary. In contrast to fastening with a Velcro fastener, helmet accessories and helmet components can be securely and firmly fastened to the at least one leg element, for example. The fastening crown can be fixed directly or indirectly to the interior of the helmet shell. For example, the fastening crown can be glued tight directly to the interior of the helmet shell or fastened to an intermediate layer that is fixed to the interior of the helmet shell. It can also be provided that the fastening crown is configured directly as part of the helmet shell. This can be the case, for example, with an injection-molded helmet shell.

The fastening crown can be annular and accordingly can form a ring that has a central recess. The ring can be closed. Alternatively, the ring can have at least one interruption so that it is an open ring. The ring is not necessarily a circular ring but can also have other shapes, e.g. elliptical or polygonal. The fastening crown can comprise a plurality of corners along the ring.

The at least one leg element can extend, starting from the fastening crown, free-standing in the direction of the helmet shell lower edge. The term free-standing can mean that the leg element is not fixed directly to the helmet shell. The leg element does not have to be connected to the helmet shell except indirectly by the fastening crown. The leg element does not have to be connected to other leg elements directly or indirectly, e.g. via a headband. The at least one leg element can be fixed to the fastening crown by a snap-in holder. A holding length of the leg element which the leg element protrudes in the direction of the helmet shell lower edge can be varied. As a result, the elements and components fastened to the leg element can be adjusted in their height.

The fastening crown can be fixed directly to a textile layer, wherein the textile layer is fixed to the interior of the helmet shell. In this embodiment, the fastening crown can be accordingly fixed indirectly to the interior of the helmet shell via the textile layer. The textile layer can extend over the interior of the helmet shell. The textile layer can be pressed into the helmet shell. The fastening crown can be fixed to a front side of the textile layer. A rear side of the textile layer can be fixed to the helmet shell.

The fastening crown can be sewn onto the textile layer. In this way, a secure and durable fastening of the carrying frame to the helmet shell can be ensured. In the production of the safety helmet, the fastening crown can be first sewn onto the textile layer before the textile layer is pressed into the helmet shell. The fastening crown can be sewn indirectly via the textile layer onto the interior of the helmet shell and pressed in, and/or glued to the interior of the helmet shell, and/or at least partially incorporated into the interior of the helmet shell. An advantage of sewing or incorporating the fastening crown into the helmet shell is that the carrying frame can be already connected to the helmet shell during the manufacture of the helmet shell and can hold firmly to the helmet shell.

A shock-absorbing pad can be fixed to the leg element. A shock-absorbing pad can be a cushion-shaped shock-absorbing element that is frequently arranged on the interior of safety helmets to absorb impacts. Frequently however the shock-absorbing pad is fixed to the helmet interior with adhesive or a Velcro fastener. By fixing the shock-absorbing pad to the leg element, it can be held much more securely in the safety helmet and can also be easily adjusted in its height. By the leg element, additional elasticity can also be provided in the direction of the helmet shell, by which the lateral impacts are absorbed more. A leg element to which a shock-absorbing pad is fixed can be referred to as a padded leg element. A front shock-absorbing pad can be fixed to a front leg element, a left shock-absorbing pad can be fixed to a left leg element, and a right shock-absorbing pad can be fixed to a right leg element.

The leg element can comprise a holder configured to fix a helmet accessory by a form fit, and/or latching, and/or clamping. By the holder, the shock-absorbing pad can be fixed to the leg element, for example. Other helmet accessories such as headphones or visors can also be fixed by the holder to the leg element. Fixation by form fit, latching and/or a clamping tight can be clearly less sensitive to temperature fluctuations in comparison to fixation by adhesive. In addition, many materials suitable for shock absorption such as expanded polypropylene (EPP) or expanded polystyrene (EPS) are not or only poorly suited for fixing by adhesive. The holder of the leg element can therefore enable secure fixing of shock-absorbing elements.

The at least one leg element can comprise at least two leg elements, wherein the at least two leg elements stretch a flexible head contact element between them, wherein the flexible head contact element can be arranged between the fastening crown and the helmet shell lower edge. Overall, the carrying frame accordingly can comprise at least two leg elements. The carrying frame may comprise one or more free-standing leg elements and two or more leg elements that are indirectly connected together, for example via the head contact element.

The flexible head contact element can be configured to lie against the head of a user and/or to snugly fit against the head of a user. Due to the head contact element, the head of the user does not lie directly against the helmet shell so that impacts on the helmet shell are not directly transmitted to the head of the user. The flexible head contact element can be stretched between the helmet shell top and the helmet shell lower edge by the leg elements. If an impact is exerted on the helmet shell, the helmet shell moves downwards in the direction of the head contact element and accordingly the head of the user. Since the leg elements form the connection between the fastening crown and the head contact element, they are compressed by the impact. The energy of the impact can be converted into deformation energy so that the leg elements strongly dampen the impact for the user. Due to the material properties and the shape of the leg elements, the shock absorption properties of the safety helmet can be easily established.

The carrying frame can have at least four stiffened leg elements that stretch the head contact element between them. The carrying frame can comprise a front right leg element, a front left leg element, a rear right leg element, and a rear left leg element. These four leg elements can stretch the head contact element between them and can be referred to as stretching leg elements. The leg elements do not have to be connected to each other, except indirectly through the head contact element and the fastening crown.

In this description, directions such as up, down, left, right, front and back refer to the situation where the user wears the helmet on the head and holds the head straight. In this case, the opening of the helmet is located on the underside of the helmet shell, while the top of the helmet shell is closed. The front of the helmet shell is aligned in the direction of the face and forehead of the user, and the rear in the direction of the back of the head. The safety helmet can comprise a neck guard which adjoins the helmet shell at the rear. The helmet shell can have a basically hemispherical shape. The helmet shell lower edge can surround the opening on the underside of the safety helmet.

According to one embodiment, the flexible head contact element can be a central inner net. The inner net can be, for example, a hair net. According to another embodiment, the flexible head contact element can be an elastic cloth. The flexible head contact element can be produced from a textile or a plastic. The head contact element can have openings. The openings can prevent increased sweat from forming under the head contact element. The flexible head contact element can be configured to lie against the head of the user. The head contact element can be stretchable in the direction of the leg elements that stretch the head contact element.

The fastening crown of the carrying frame can be arranged at a distance from the head contact element and does not directly touch the head contact element. A gap can be accordingly formed between the fastening crown and the head contact element. In this way it can be ensured that the helmet shell can move towards the head contact element in reaction to an impact by bending the leg elements without the helmet shell touching the head contact element.

The leg elements can each have a fastening point to which the head contact element is fastened, wherein the fastening point can be arranged below the fastening crown, wherein the fastening point can be arranged in a lower half of the leg elements. By the fastening points of the leg elements, a position can be specified at which the head contact element is fixed to the leg elements. For example, the fastening point can comprise a slot or another element for fixing the head contact element.

According to one embodiment, at least one of the leg elements can have a plurality of fastening points that are arranged one behind the other along a longitudinal direction of the leg element. By providing a plurality of fastening points on one leg element, the height of the fixation of the head contact element can be changed. In this way, the helmet can, for example, be adapted to different head shapes, and/or the damping properties can be changed.

The head contact element can be fixed exclusively to the fastening points of the leg elements. In other words, apart from the leg elements, there are no other fastening elements that fix the head contact element to the helmet shell. In this way, it can be ensured that the forces of the impact would not be transmitted directly to the head contact element via an additional fastening element, and in this way reduce the damping.

The leg element can have a flat shape, wherein a length of the leg element can be greater than a width of the leg element, and the width can be greater than a thickness of the leg element, wherein the width can be at least ten times as large as the thickness of the leg element. Due to this shape, a good fastening option for helmet accessories can be provided, and a good damping effect can be ensured. The thickness of the leg element can be 0.2 mm to 1.0 mm.

The leg element can be rigid in the direction of the width and can have greater flexibility in the direction of the thickness than in the direction of the width. By the shape and structural properties of the leg element, it can be ensured that the leg element bends in the direction of the thickness in the event of an impact, but not in the direction of the width or length. In this way, the direction of the deformation and accordingly the strength of the damping can be specified.

The leg element can be arranged in such a way that an outer surface of the leg element can be aligned with the interior of the helmet shell, wherein the outer surface can extend along the length and width of the leg element. The outer surface of the leg element can run parallel to the interior of the helmet shell. This alignment, together with the shape of the leg element, can result in a middle section of the leg element bending outwards in the direction of the helmet shell in the event of an impact on the helmet shell. A lower section of the leg element, on the other hand, can be bent in the direction of the helmet interior.

The leg element can be curved, wherein a curvature of the leg element follows a curvature of the helmet shell. In other words, the leg element can be pre-bent. By the curvature of the leg element, a direction of bending can be specified in reaction to an impact so that the forces are introduced into the leg element in a targeted manner.

The fastening crown can be fixed to an upper area of the helmet shell. The fastening crown can be fixed, such as exclusively, to an upper hemisphere third, or hemisphere quarter, of the helmet shell. The hemisphere thirds or hemisphere quarters can be defined in such a way that they extend from the helmet shell lower edge to the top of the helmet shell. Neck protection is not taken into account. The helmet shell can be divided along the height of the helmet shell into three or four parts of equal height. The fastening crown can be fixed, such as exclusively, in this upper hemisphere third or hemisphere quarter. Starting from this positioning of the fastening crown, the leg element or leg elements can extend downwards in the direction of the helmet shell lower edge. In this way it can be ensured that the leg element or the leg elements can effectively absorb the energy of impacts so that the head of the user is protected. The fastening crown can be fixed to the upper hemisphere third or hemisphere quarter by the textile layer.

The fastening crown can have an outer edge and a central recess, wherein the leg element can project outwards from the outer edge. This shape of the fastening crown can allow easy fixation to the helmet shell. In addition, the leg element can be arranged along the interior of the helmet shell as required for the particular safety helmet. The outer edge and/or the fastening crown can be configured in such a way that the outer edge and/or the fastening crown follows a line of the same height in the helmet shell. In other words, the fastening crown can be arranged horizontally in the helmet shell. The fastening crown can have a flat shape whose edge is formed by the outer edge. The fastening crown can have a polygonal shape, for example an octagonal shape.

The leg element, and the fastening crown, can be made of a pressed plastic or comprises a pressed plastic. A pressed plastic can be advantageous because can lend the leg elements the necessary stability and rigidity to dampen shocks by deformation.

According to one embodiment, the pressed plastic can be a polypropylene fabric that can be pressed into a flat matrix. The leg element can consist of the polypropylene fabric. A pressed polypropylene fabric can have the necessary stiffness and stability for the leg element. During production, the polypropylene fabric can be pressed into a sheet. The leg element or the leg elements can be then cut out of this sheet. For example, the pressed polypropylene fabric can be the material known under the brand name "Curv" by the company Propex.

According to a further embodiment, a helmet accessory can be fixed to at least one of the leg elements. The helmet accessory can be, for example, a belt system, a sensor, a microphone, headphones, a visor or a similar helmet accessory.

According to one embodiment, the leg element can be fixed to the fastening crown in a height-adjustable manner. Due to the height adjustability of the leg element, the position of the head contact element and/or the shock-absorbing pads and/or other helmet accessories can be changed. For example, the leg element can have different latching sections with which it can be fixed to the fastening crown. Depending on the employed latching section, the leg element can protrude downward to a varying extent in the direction of the helmet shell lower edge.

Overall, the carrying frame can significantly improve the seating of the safety helmet. A lateral tilting of the safety helmet on the head of the user can be reduced. The better seating of the safety helmet on the head means that rolling and yawing movements of the safety helmet are much better prevented which increases wearing comfort.

BRIEF DESCRIPTION OF THE DRAWINGS

Further features will become evident from the description of embodiments, together with the claims and the appended drawings. Embodiments can fulfill individual features or a combination of multiple features.

The embodiments will be described below without restricting the general concept of the invention by exemplary embodiments with reference to the drawings, wherein reference is expressly made to the drawings regarding all of the details which are not explained in greater detail in the text, wherein.

DETAILED DESCRIPTION

Figure 1:
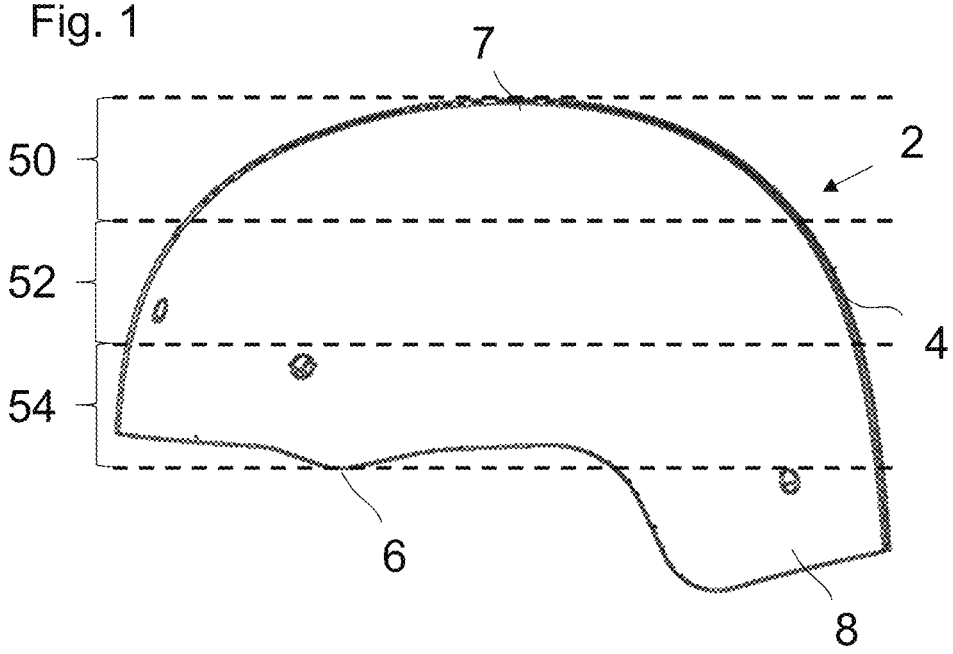
FIG. 1 illustrates a schematically simplified side view of a safety helmet with neck guard.

In the drawings, the same or similar elements and/or parts are, in each case, provided with the same reference signs, and therefore they are not introduced again in each case.

FIG. 1 shows a schematically simplified side view of a safety helmet 2 with a helmet shell 4 and a neck guard 8. An upper helmet section 7 of the helmet shell 4 is also termed the helmet crown. A helmet shell lower edge 6 encloses an opening in the helmet shell 4 in its underside. In FIG. 1, the helmet shell 4, without the neck guard 8, is divided into an upper hemisphere third 50, a middle hemisphere third 52 and a lower hemisphere third 54, each of which has the same height.

Figure 2:
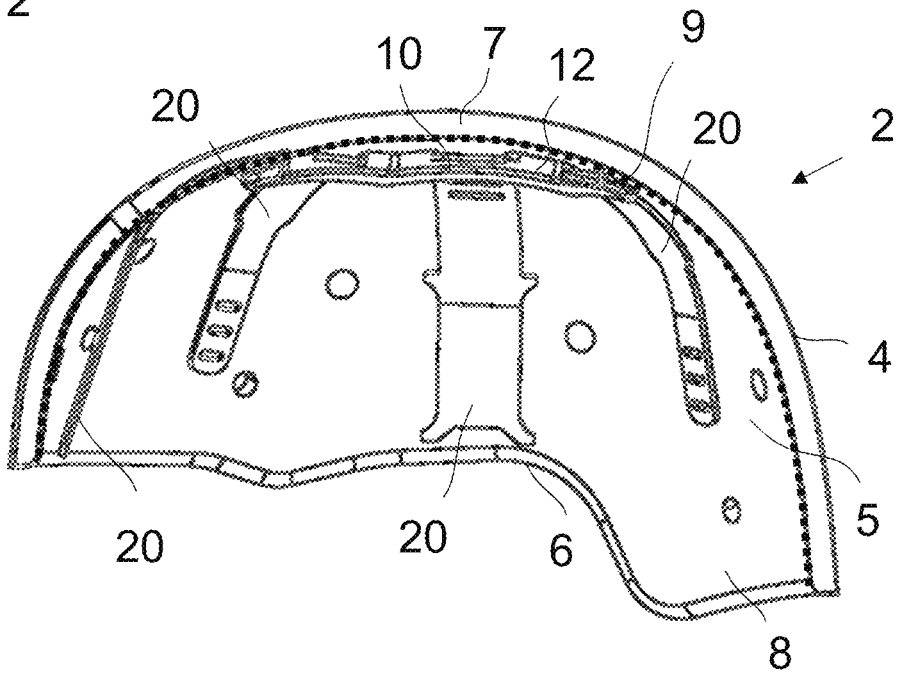
FIG. 2 illustrates a schematically simplified cross-sectional view of the helmet shown in FIG. 1.

FIG. 2 shows a cross-sectional view of the helmet from FIG. 1. It can be seen that a fastening crown 12 of a carrying frame 10 is fixed to the interior 5 of the helmet shell 4 in the upper hemisphere third 50. In the shown exemplary embodiment, the fixing is accomplished by a textile layer 9 to which the fastening crown 12 is sewn, for example. The textile layer 9 in turn is pressed into the interior 5 of the helmet shell 4. In FIG. 2, the textile layer 9 is represented by a dotted line running along the inner side of the helmet shell 4. The carrying frame 10 also has a plurality of leg elements 20 which extend downwards starting from the fastening crown 12 in the direction of the helmet shell lower edge 6. The fastening crown can however also be fixed directly to the interior 5 of the helmet shell 4, for example glued in. It is also possible to form the fastening crown as a component of the helmet shell 4.

Figure 3:
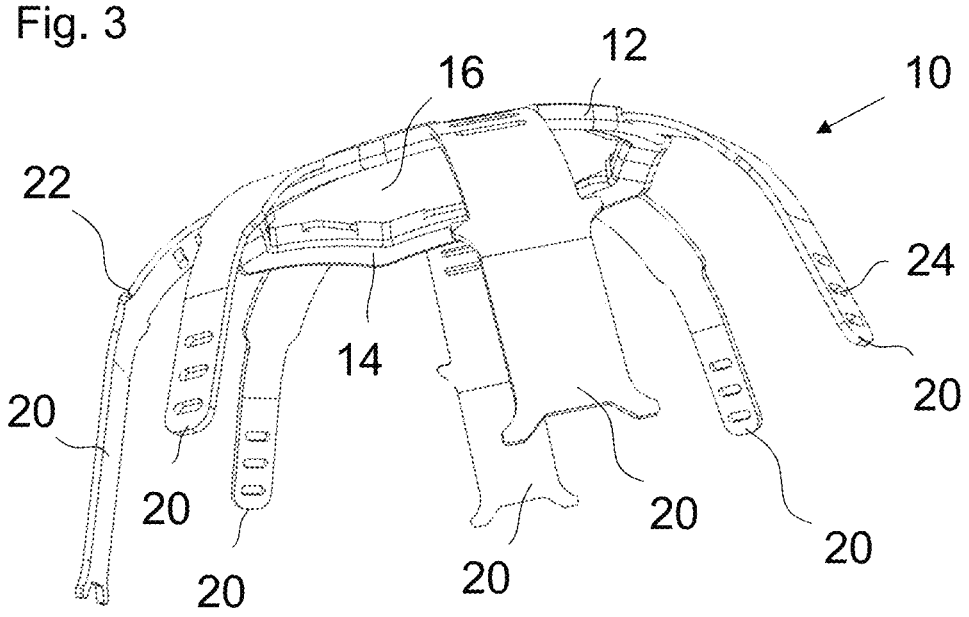
FIG. 3 illustrates a schematically simplified perspective representation of a carrying frame for a safety helmet.

The carrying frame 10 is shown in FIG. 3 in a perspective view. In this view, it is clear that the fastening crown 12 has an annular shape with an outer edge 14 and a central recess 16 which is surrounded by the outer edge 14. The outer edge 14 has an octagonal shape with eight sides. One of the leg elements 20 protrudes outwards from each of seven of these eight sides. The leg elements 20 each have a curvature 22 that substantially follows the curvature of the helmet shell 4. Two different types of leg elements 20 are provided in the embodiment in FIG. 3. Three of the leg elements 20 on the front side, the left side and the right side are widened and configured as padded leg elements which are configured to accommodate shock-absorbing pads. The other four leg elements 20 contrastingly each have a plurality of fastening points 24 in the form of slots on their lower section. These slots are provided to stretch a flexible head contact element, for example a hair net, between them. These four leg elements 20 are stretching leg elements. The number of padded leg elements and stretching leg elements can however differ from the number of leg elements 20 in FIG. 3. For example, the head contact element can only be stretched by two leg elements 20, and more or fewer than three padded leg elements can be provided. In addition, leg elements 20 can be provided to accommodate further helmet accessories, for example for a belt system, sensors, a microphone or headphones.

Figure 4:
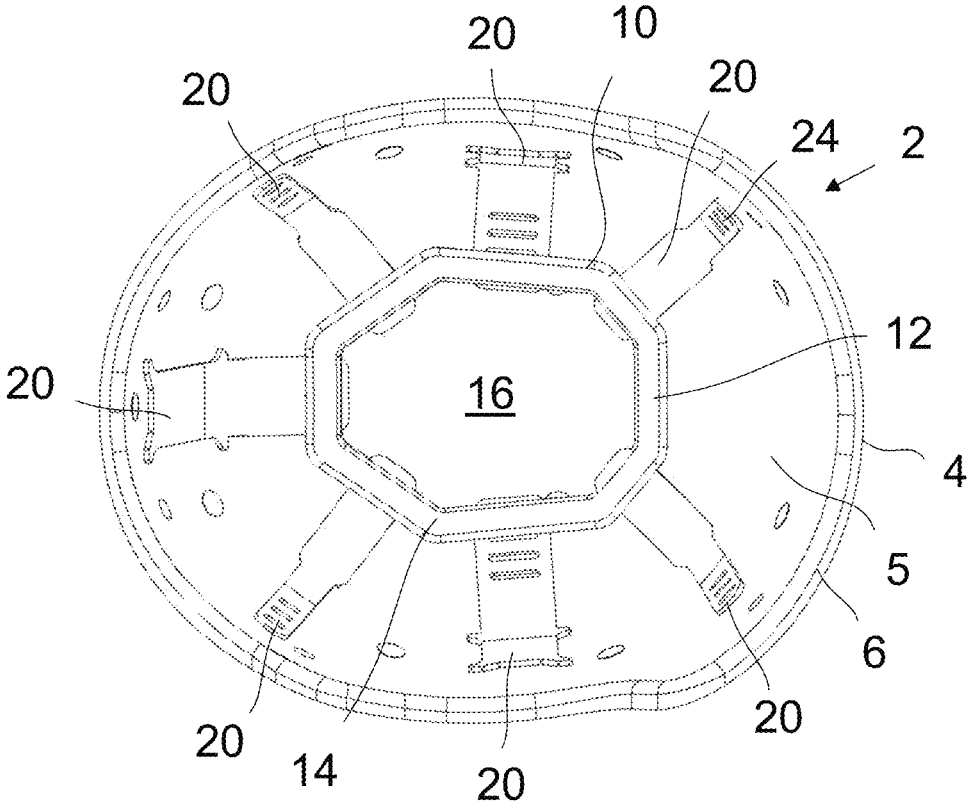
FIG. 4 illustrates a schematically simplified view of a safety helmet with a carrying frame from below.

FIG. 4 shows a safety helmet 2 with the carrying frame 10 in a view from below. The carrying frame 10 is only fixed to the helmet shell 4 with the fastening crown 12; the leg elements 20 are contrastingly free. For this purpose, the outer edge 14 is, for example, sewn and pressed onto the helmet shell 4 in the area of the upper helmet section 7 by the textile layer 9, or is already inserted into the helmet shell during the production of the helmet shell 4. According to another embodiment, the outer edge 14 can also be glued tight to the textile layer 9.

Figure 5:
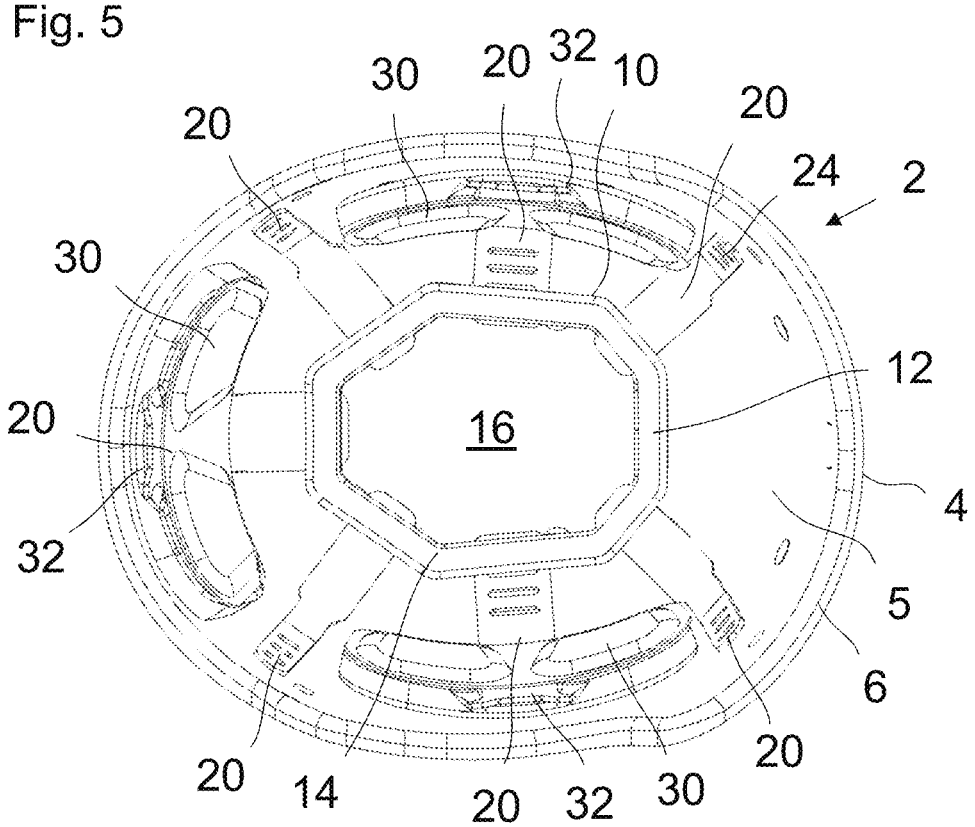
FIG. 5 illustrates a schematically simplified representation of the safety helmet from FIG. 4 with padding elements.

As shown in FIG. 5, a shock-absorbing pad 30 is fixed to each of the front, left and right leg elements 20. In this way, the shock-absorbing pads 30 can be arranged in the safety helmet 2 without providing fastening means, for example in the form of a Velcro fastener, directly on the helmet shell 4. Instead, the shock-absorbing pads 30 are fixed to the leg elements 20 via a holder 30, which works with a latch, a clamping device and/or a form fit. Such a fixation is also much more temperature-resistant than a fixation by an adhesive and less prone to wear than a fixation by a Velcro fastener. The shock-absorbing pads 30 are also given increased flexibility by the leg elements 20, whereby the fit of the safety helmet 2 can be adapted to different head shapes, and the damping of the safety helmet 2 is increased. The leg elements 20 for accommodating the padding elements 30 can be configured height-adjustable. For example, the leg elements 20 comprise different slots with which the leg elements 20 can be fixed to the fastening crown 12.

Figure 6:
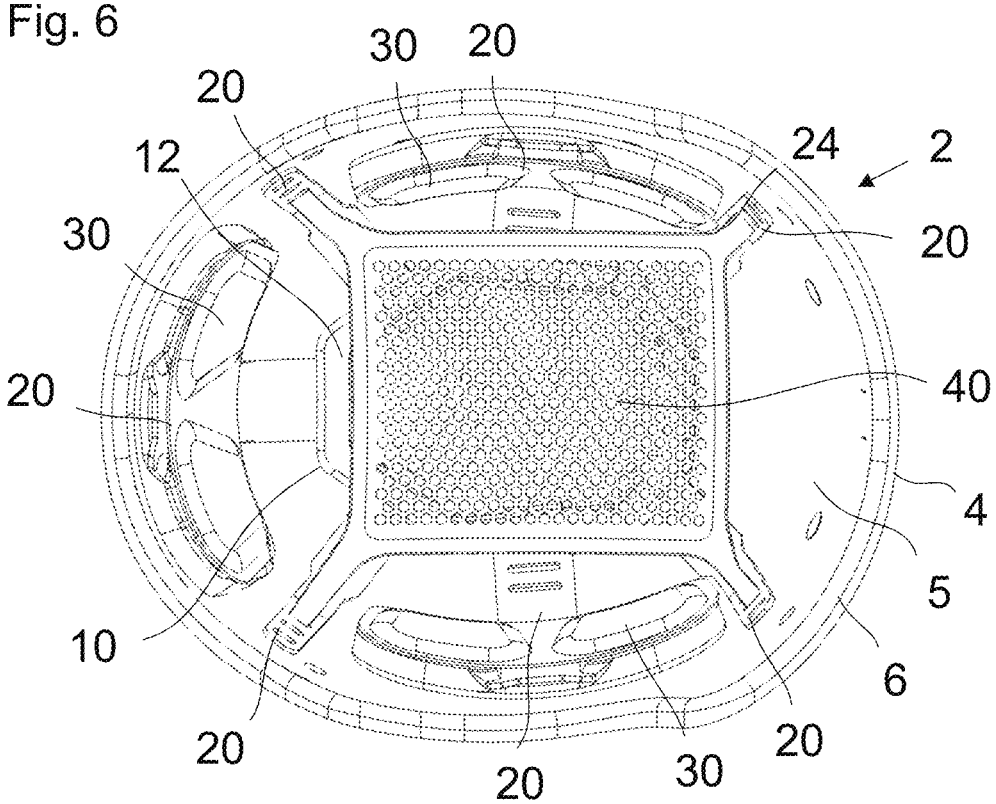
FIG. 6 illustrates a schematically simplified representation of the safety helmet from FIG. 5 with an elastic head contact element which is stretched by the carrying frame.

In FIG. 6, a flexible head contact element 40 in the form of a net is stretched between the other four leg elements 20. The head contact element 40 can, for example, be a textile net or a plastic net which, for example, is configured as a hair net. In any case, the head contact element 40 is configured to lie against the head of the user when he is wearing the safety helmet 2.

If an impact is exerted on the helmet shell 4, the upper helmet section 7 of the helmet shell 4 moves in the direction of the head contact element 40 which lies against the head of the user. Due to the energy of the impact, there is a deformation of the leg elements 20 which are deformed as specified by the curvature 22 in order to absorb the impact energy. In this way, the impacts against the head of the user are absorbed. In contrast to safety helmets 2 in which, for example, a hair net is fixed directly to the helmet shell 4 in the area of the helmet shell lower edge 6, in the safety helmet from FIG. 6, the energy of the impact is transmitted indirectly via the leg elements 20. While a fixation in the area of the helmet shell lower edge 6 only results in a stretching of the head contact element 40 in reaction to an impact, in the safety helmet 2 from FIG. 6, the impact forces are also absorbed by the bending of the leg elements 20.

The functionality of the leg elements 20 for absorbing the energy of the impact is improved in that the carrying frame 10 is fixed to the helmet shell 4 above the head contact element 40 by the fastening crown 12. This gives the upper helmet section 7 and the head contact element 40 play to move towards each other in reaction to the impact and to absorb the energy through the leg elements 20.

Figure 7:
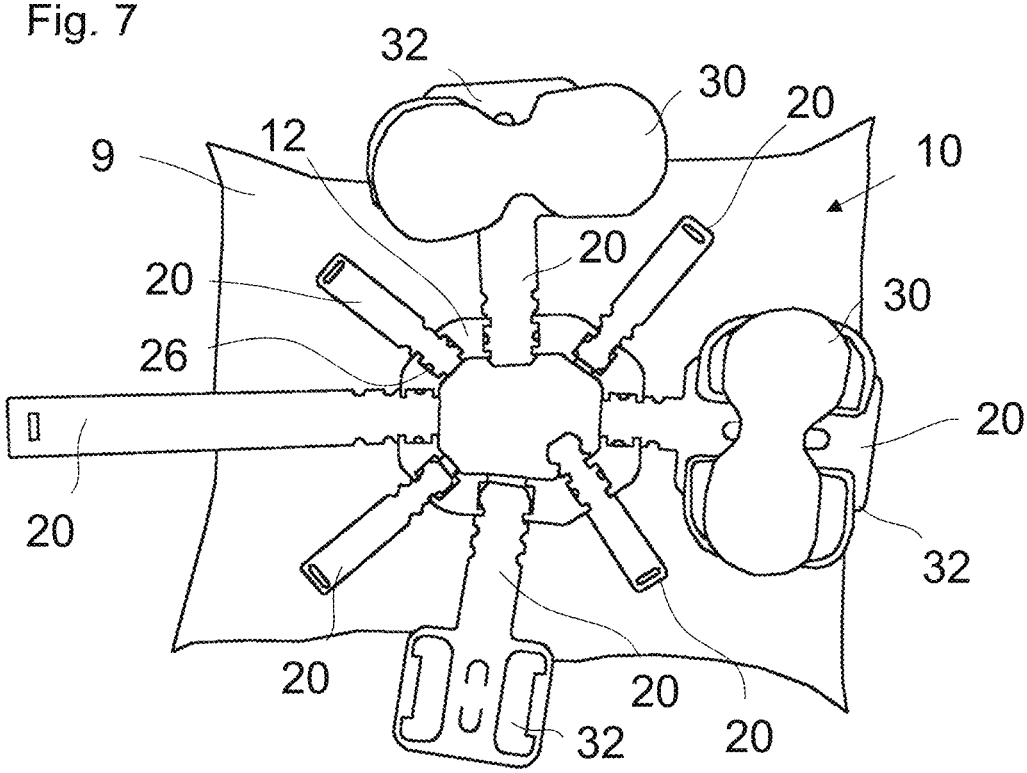
FIG. 7 illustrates a schematically simplified representation of a further embodiment of a carrying frame from below which is sewn to a textile layer.
Figure 8:
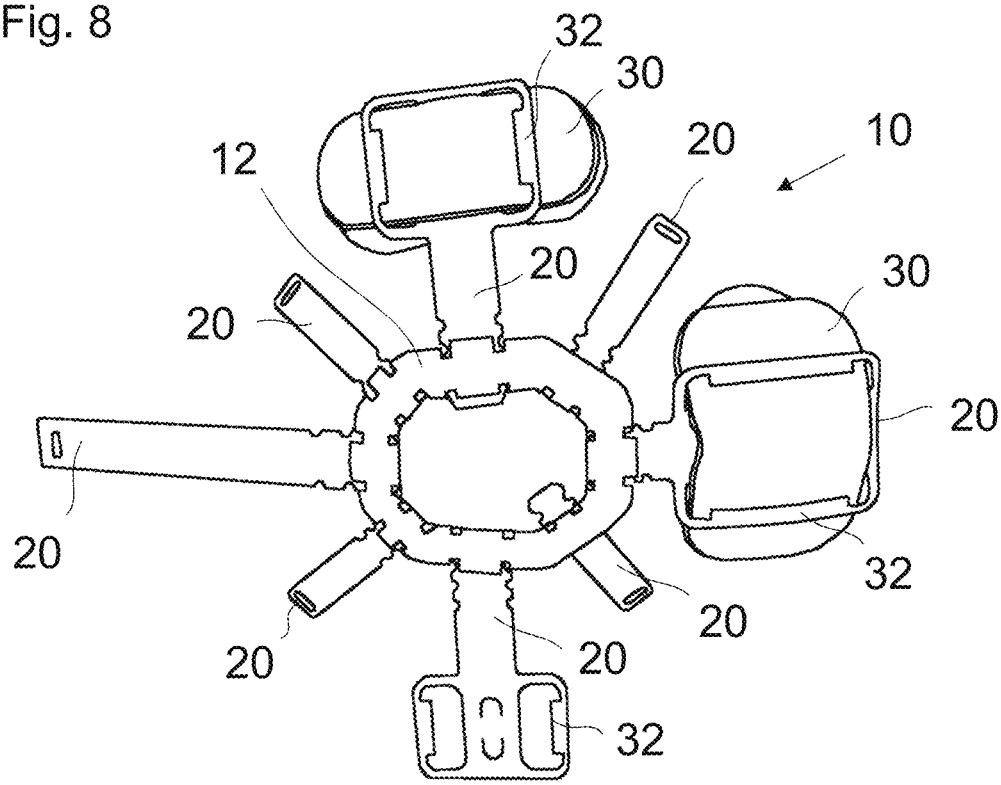
FIG. 8 illustrates a schematically simplified representation of the carrying frame from FIG. 7 from above.

FIG. 7 shows another embodiment of a carrying frame 10 in a view from below. In FIG. 8, the same carrying frame 10 is shown in a view from above. The upper side of the fastening crown 12 of the carrying frame 10 is sewn to a textile layer 9 which is schematically indicated in FIG. 7. The carrying frame 10 comprises a total of eight leg elements 20, four of which are configured to accommodate a head contact element 40. Shock-absorbing pads 30 are fixed to three of the leg elements 20 by a holder 32. The holder 32 comprises two openings through which a part of the shock-absorbing pads 30 are pushed in order to clamp them to the leg elements 20. These openings are clearly visible with the leg element 20 which is arranged at the bottom in FIGS. 7 and 8 and does not yet comprise a shock-absorbing pad 30. Another leg element 20 is configured particularly long and is configured to accommodate helmet accessories, for example a visor. The leg elements are each fixed to the fastening crown 20 by a snap-in holder 26. The snap-in holder 26 makes it possible to change the holding length of the leg elements 20. For example, the leg element 20 at the bottom right has a reduced holding length compared to the other leg elements 20 due to an altered fixation and therefore protrudes less in the direction of the helmet shell lower edge 6.

While there has been shown and described what is considered to be embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

LIST OF REFERENCE SIGNS

2 Safety helmet
4 Helmet shell
5 Interior
6 Helmut shell lower edge
7 Upper helmet section
8 Neck guard
9 Textile layer
10 Carrying frame
12 Fastening crown
14 Outer edge
16 Recess
20 Leg element
22 Curvature
24 Fastening point
26 Snap-in holder
30 Shock-absorbing pad
32 Holder
40 Head contact element

50 Upper hemisphere third
52 Middle hemisphere third
54 Lower hemisphere third

What is claimed is:

1. A safety helmet comprising:

a helmet shell having an upper dome section and a lower edge extending from the upper dome section; and a carrying frame comprising an annular fastening crown;

wherein the fastening crown is one of fixed to the interior of the upper dome section of the helmet shell or is configured fixed to the upper dome section of the helmet shell as a component of the interior of the upper dome section of the helmet shell; and the carrying frame comprises at least one stiffened leg element extending free-standing from the fastening crown in a direction of a helmet shell toward the lower edge of the safety helmet, wherein a fixed end of the at least one stiffened leg element is fixed to a portion of the fastening crown that is fixed to the upper dome section of the helmet and a free end of the at least one stiffened leg element extends toward the lower edge;

the free end is unattached to the helmet shell; and the free end of the at least one stiffened leg element comprises a holder configured to fix a helmet accessory.

2. The safety helmet according to claim 1, wherein the fastening crown is fixed directly to a textile layer, wherein the textile layer is fixed to the interior of the helmet shell.

3. The safety helmet according to claim 2, wherein the fastening crown is sewn onto the textile layer.

4. The safety helmet according to claim 2, wherein the textile layer is pressed into the interior of the helmet shell.

5. The safety helmet according claim 1, further comprising a shock-absorbing pad fixed to the at least one stiffened leg element.

6. The safety helmet according to claim 1, wherein the at least one stiffened leg element comprises a holder configured to fix a helmet accessory by one or more of a form fit, latching and clamping.

7. The safety helmet according to claim 1, wherein the at least one stiffened leg element comprises at least two stiffened leg elements, wherein the at least two stiffened leg elements stretch a flexible head contact element between them, wherein the flexible head contact element is arranged between the fastening crown and the helmet shell lower edge.

8. The safety helmet according to claim 7, wherein the flexible head contact element is a central inner net.

9. The safety helmet according to claim 7, wherein the fastening crown is arranged offset from the head contact element such that the fastening crown does not directly touch the head contact element.

10. The safety helmet according to claim 7, wherein the at least two stiffened leg elements each have a fastening point at which the head contact element is fastened to the at least two stiffened leg elements, the fastening point is arranged below the fastening crown, and the fastening point is arranged in the at least two stiffened leg elements.

11. The safety helmet according to claim 10, wherein the fastening point is arranged a lower half of the at least two stiffened leg elements.

12. The safety helmet according to claim 10, wherein at least one of the at least two stiffened leg elements has a plurality of fastening points which are arranged one behind the other along a longitudinal direction of the leg element.

13. The safety helmet according to claim 10, wherein the head contact element is fixed exclusively to the fastening points of the at least two stiffened leg elements.

14. The safety helmet according to claim 1, wherein the at least one stiffened leg element has a flat shape, a length of the at least one stiffened leg element is greater than a width of the at least one stiffened leg element, and the width is greater than a thickness of the at least one stiffened leg element.

15. The safety helmet according to claim 14, wherein the width is at least ten times as large as the thickness of the at least one stiffened leg element.

16. The safety helmet according to claim 14, wherein the at least one stiffened leg element is rigid in the direction of the width and has greater flexibility in the direction of the thickness than in the direction of the width.

17. The safety helmet according to claim 1, wherein the at least one stiffened leg element is curved, wherein a curvature of the leg element follows a curvature of the helmet shell.

18. The safety helmet according to claim 1, wherein the fastening crown is fixed, exclusively, to one of an upper hemisphere third or an upper hemisphere quarter of the helmet shell.

19. The safety helmet according to claim 1, wherein one or more of the at least one stiffened leg element, and the fastening crown comprises a pressed plastic.

20. The safety helmet according to claim 19, wherein the pressed plastic is a polypropylene fabric pressed into a flat matrix.

* * * * *